US005267937A

United States Patent [19]

Zettier et al.

[11] Patent Number: 5,267,937

[45] Date of Patent: Dec. 7, 1993

[54] CENTRIFUGE WITH A SELF-EVACUATING DRUM

[75] Inventors: Karl-Heinz Zettier; Siegfried Smigielski, both of Olede, Fed. Rep. of Germany

[73] Assignee: Westfalia Separator AG

[21] Appl. No.: 920,491

[22] PCT Filed: Jan. 22, 1991

[86] PCT No.: PCT/EP91/00114

§ 371 Date: Aug. 12, 1992

§ 102(e) Date: Aug. 12, 1992

[87] PCT Pub. No.: WO91/12081

PCT Pub. Date: Aug. 22, 1991

[30] Foreign Application Priority Data

Feb. 14, 1990 [DE] Fed. Rep. of Germany ..... 4004459

[51] Int. Cl.[5] ..... B04B 11/02

[52] U.S. Cl. ..... 494/56; 494/61

[58] Field of Search ..... 494/56, 61, 26, 35, 494/37, 42, 85, 57, 43, 23

[56] References Cited

U.S. PATENT DOCUMENTS 4,631,048 12/1986 Titus ..... 494/56

FOREIGN PATENT DOCUMENTS 1023726 1/1958 Fed. Rep. of Germany .

2151475 4/1973 Fed. Rep. of Germany .

1481803 5/1967 France .

*Primary Examiner*—Robert W. Jenkins

*Attorney, Agent, or Firm*—Sprung Horn Kramer & Woods

[57] ABSTRACT

A centrifuge with a self-evacuating drum, with a line for feeding the drum with the stock to be centrifuged, with at least one outlet line with an elastic section for extracting a liquid phase from the drum under pressure, and with a mechanism for expelling solids from the drum at prescribed intervals. The elastic section is accommodated in an air-tight housing. The housing communicates with a compressor through a line. The line accommodates a valve that opens prior to every solids expulsion and subjects the elastic section to pressure from outside, compressing it in response to the reduction in pressure accompanying the solids expulsion and forcing as much product from the elastic section as solids are expelled from the drum.

5 Claims, 1 Drawing Sheet

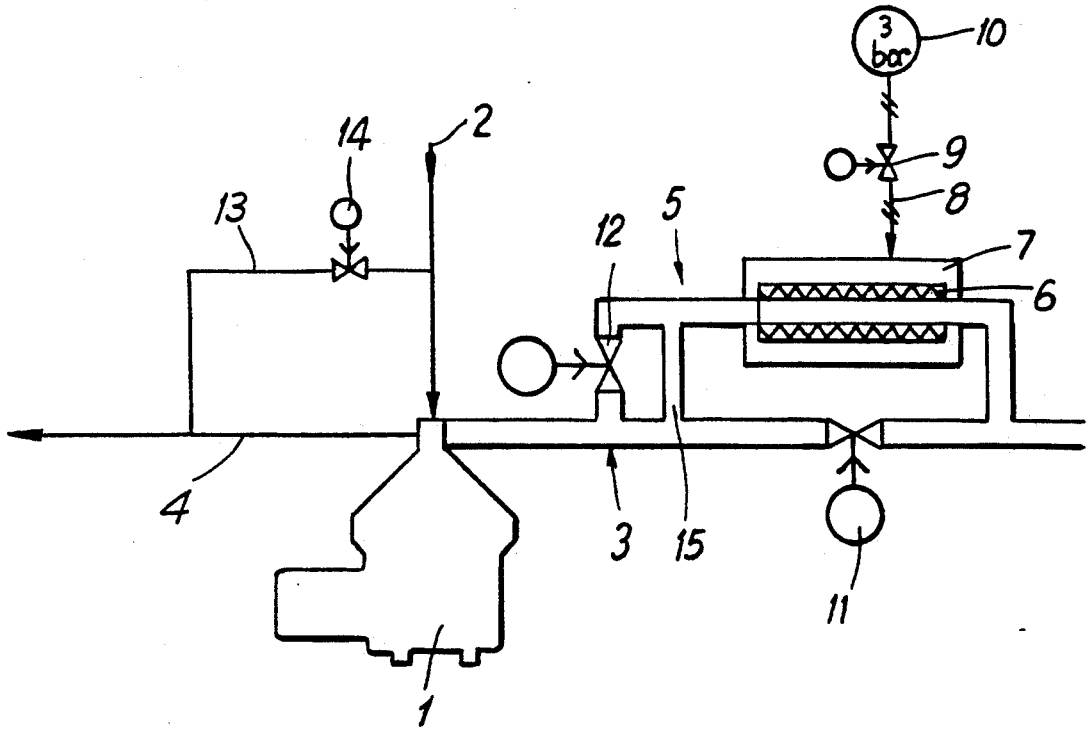
3 bar
10
9
8
7
6
5
12
14
2
13
4
3
15
11
1

CENTRIFUGE WITH A SELF-EVACUATING DRUM

BACKGROUND OF THE INVENTION

The invention concerns a centrifuge with a self-evacuating drum, with a line for feeding the drum with the stock to be centrifuged, with at least one outlet line with an elastic section for extracting a liquid phase from the drum under pressure, and with a mechanism for expelling solids from the drum at prescribed intervals.

Such centrifuges are generally known. The solids can be expelled in what are called fractional evacuations, whereby only a small fraction of the drum's contents is removed. This procedure suddenly reduces the pressure in the drum and accordingly in the outlet line, which can be detrimental to downstream equipment.

In skimming milk as described in German C 3 539 485 for example, the skimmed milk is forwarded to a heater, and heat is also transferred to the starting milk. Regulations require that the pressure at the pasteurized skim-milk end must always be higher than the pressure at the starting-milk end. This condition cannot for the aforesaid reasons be satisfied during the evacuation procedure.

A centrifuge is known from FR A 1 481 803 with a volume limiter that stretches to a certain extent in the feed line and another in at least one outlet line. The volume limiter is intended to prevent variations in the ratio between the volumes in two outlet lines when the pressure changes. These mechanisms cannot, however, compensate for a sudden reduction in pressure in an outlet line as occurs in conjunction with centrifuge drums with solids-expulsion mechanisms during the expulsion procedure. The elastic deformation of the outlet line and the associated variation in volume are so slight in relation to the materials generally employed that no effect on the pressure reduction is to be expected.

German A 2 151 475 describes a valve with a tubular diaphragm that can be subjected to external compressed air in order to vary the valve's channel and hence the rate of the fluid flowing through it. Valves of this type are also appropriate for maintaining a constant pressure in a line with a fluid flowing continuously through it. When the flow is interrupted as occurs while solids are being expelled from the drum and into the outlet lines in a centrifuge, however, such a reduction in pressure cannot be prevented.

SUMMARY OF THE INVENTION

The object of the present invention is to improve the known centrifuge such as to prevent reductions in pressure in the outlet line even while the centrifuge is being fractionally evacuated.

This object is attained in accordance with the invention in that the elastic section is accommodated in an air-tight housing, the housing communicates with a compressor through a line, and the line accommodates a valve that opens prior to every solids expulsion and subjects the elastic section to pressure from outside, compressing it in response to the reduction in pressure accompanying the solids expulsion and forcing as much product from the elastic section as solids are expelled from the drum.

The valve opens prior to fractional evacuation, subjecting the elastic section of the outlet line to pressure. When the pressure is reduced in the outlet line during the fractional evacuation, the external pressure will compress the elastic section and force out a certain volume of the product therein. The volume will equal the volume of solids expelled. These procedures will compensate for the drop in pressure.

The elastic section in one advantageous embodiment of the invention is part of a bypass line. In this event the rest of the line can be rigid, as is conventional.

Another advantageous embodiment has valves accommodated in the outlet line and the bypass line that make it possible to remove material from the centrifuge through only one of the lines. This system is of particular advantage when flushing the lines by recirculation.

When the centrifuge has another outlet line it is of advantage for the centrifuge's feed line to communicate with the second outlet line through another bypass line that accommodates a valve. In this event the valve is opened during the fractional evacuation and product is briefly forwarded from the intake into the second outlet line.

It is practical for the valves to be activated and the solids expulsion initiated by controls.

The preferred medium is compressed air.

BRIEF DESCRIPTION OF THE DRAWING

One embodiment of the invention will now be specified with reference to the drawing including a figure which is a schematic.

DETAILED DESCRIPTION OF THE INVENTION

A product that is to be centrifuged is supplied to a centrifuge 1 through a feed line 2. The liquid phases separated in the centrifuge are extracted through outlet lines 3 and 4. A bypass line 5 parallels first outlet line 3. Bypass line 5 has an elastic section 6 that is accommodated air-tight in a housing 7. Housing 7 communicates with a compressor 10 through a line 8 that accommodates a valve 9. First outlet line 3 accommodates a valve 11, and bypass line 5 another valve 12. Feed line 2 communicates with outlet line 4 through another bypass line 13 that accommodates another valve 14.

When the centrifuge is loaded with product through feed line 2, the separated liquid phases are extracted through outlet lines 3 and 4. The optimum pressure for each procedure is established by unillustrated devices. Prior to fractional evacuation, valve 9 opens, pressurizing housing 7 and compressing elastic section 6. Upon initiation of fractional evacuation, the pressure in the centrifuge will be reduced and some of the product in first outlet line 3 will flow back into the drum. The returning product will be replaced by product from elastic section 6 as it becomes compressed by the pressure difference resulting from the reduction in pressure in first outlet line 3. The valve 14 in second bypass line 13 will also be open during the evacuation procedure. Since the reduction in pressure occasioned by the evacuation lasts only approximately a second, a brief penetration of product into outlet line 4 will be acceptable in many cases. Upon termination of the evacuation procedure, first bypass line 5 is resupplied from a communicating line 15.

When liquid is circulated through first outlet line 3 to rinse it, valves 11 and 12 can be activated to rinse first bypass line 5 and first outlet line 3 separately to improve the results.

We claim:

1. A centrifuge comprising: a self-evacuating drum having an input line for stock to be centrifuged and at least one outlet line including an elastic section for extracting a liquid phase under pressure, means for expelling solids from the drum at prescribed intervals, an air-tight housing surrounding the elastic section of the at least one outlet line, a compressor, means connecting the compressor to the air-tight housing comprising an air line and a valve in the air line, means controlling the valve to open to subject the elastic section to outside pressure prior to each prescribed interval for expelling solids, whereby the elastic section will compress in response to a reduction in pressure accompanying the solids expulsion and thereby force as much product from the elastic section as solids are expelled from the drum.

2. The centrifuge as in claim 1, further comprising a bypass line paralleling the at least one outlet line and wherein the elastic section is part of the bypass line.

3. The centrifuge as in claim 2, further comprising valves in the at least one outlet line and in the bypass line to effect removal of material through only one of the lines.

4. The centrifuge as in claim 3, further comprising a second outlet line and a second bypass line with valves therein and wherein the input line communicates with the second outlet line through the second bypass line.

5. A centrifuge as in claim 4, wherein the control means has means for activating all of the valves and initiating solids expulsion.

* * * * *